United States Patent [19]

Samuels et al.

[11] 4,006,547

[45] Feb. 8, 1977

[54] GARMENT HANGER WITH INDICIA MEANS

[75] Inventors: Howard Samuels, Brooklyn, N.Y.; Robert Phillips, Fort Lee, N.J.

[73] Assignee: Warbern Packaging Industries, Inc., Keasbey, N.J.

[22] Filed: Oct. 2, 1975

[21] Appl. No.: 618,975

[52] U.S. Cl. ..... 40/322; 223/85

[51] Int. Cl.[2] ..... G09F 3/00

[58] Field of Search ..... 223/85, 87, 88, 92, 223/95, 96; 211/113; 40/322, 1.5, 10 R, 16 R

[56] References Cited

UNITED STATES PATENTS

| | | | |
|---|---|---|---|
| 1,348,952 | 8/1920 | Landry | 40/322 |
| 1,389,266 | 8/1921 | Newton | 40/322 |
| 2,801,036 | 7/1957 | Klein | 40/322 X |

FOREIGN PATENTS OR APPLICATIONS

| | | | |
|---|---|---|---|
| 1,546,150 | 10/1968 | France | 223/85 |

*Primary Examiner*—George H. Krizmanich
*Attorney, Agent, or Firm*—Blum, Moscovitz, Friedman & Kaplan

[57] ABSTRACT

A garment hanger of the type having a garment carrying body and a hook with the body provided for carrying indicia means on selected portions thereof to disclose information about or relating to the garment to prospective purchasers. The indicia means are removable and changeable, as desired.

7 Claims, 4 Drawing Figures

FIG. 1
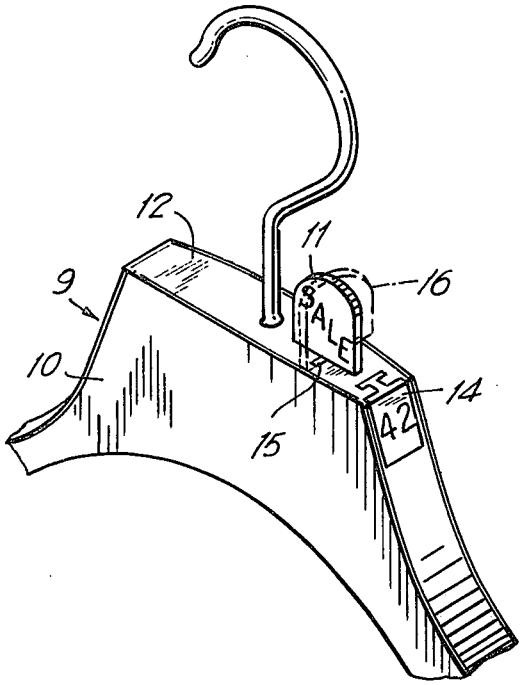
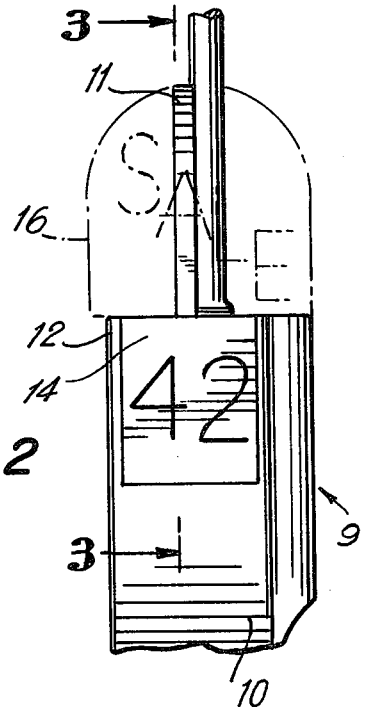
FIG. 2
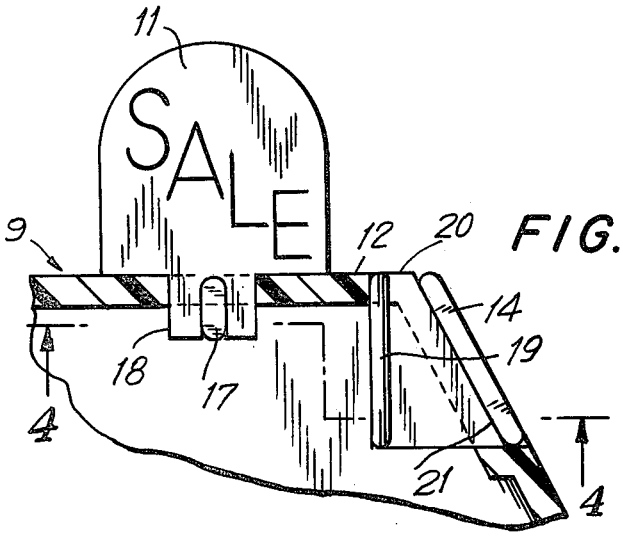
FIG. 3
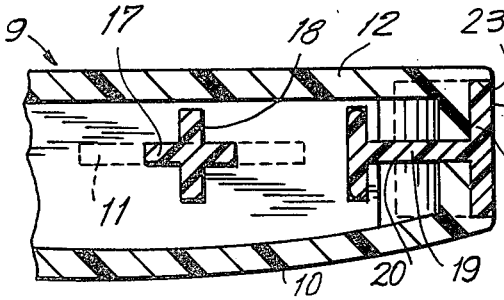
FIG. 4

GARMENT HANGER WITH INDICIA MEANS

BACKGROUND OF THE INVENTION

This invention relates generally to a garment hanger capable of carrying visible indicia means which are removable so as to maximize the versatility of use of the garment hanger. While garment hangers with indicia means are known in the art, the present invention represents a novel and improved arrangement.

SUMMARY OF THE INVENTION

Generally speaking, in accordance with the invention, a plastic hanger is provided with removable indicia means for attachment to portions of the body of the hanger. A first type of indicia means is mounted at the neck or other visible portion of the hanger, preferably flush therewith, for carrying indicia such as garment size. Another type of indicia means may be removably mounted for ready observance of selected information, such as the fact that the garment on the hanger is "on sale." Depending on the type of garment rack on which the garment will be hung by means of the hanger, one form of the indicia means may be selectively positioned in different planes for different directions of visual observation.

Accordingly, it is an object of this invention to provide a garment hanger having improved indicia means visible to prospective customers and retail store personnel.

Another object of this invention is to provide an improved garment hanger having indicia means whereby the indicia means are carried flush with a surface of the hanger.

A further object of this invention is to provide an improved hanger with indicia means which extend above the main body of the hanger for ready observation.

Still another object of this invention is to provide an improved hanger carrying indicia means which permit a manufacturer to pre-size garments by correlating the garment size with indicia means on the hanger while permitting the indicia means to be subsequently changed in order to render the hangers reusuable.

Still other objects and advantages of the invention will in part be obvious and will in part be apparent from the specification and drawings.

The invention accordingly comprises the features of construction, combinations of elements, and arrangements of parts which will be exemplified in the construction hereinafter set forth and the scope of the invention will be indicated in the claims.

BRIEF DESCRIPTION OF THE DRAWINGS

For a fuller understanding of the invention, reference is had to the following description taken in connection with the accompanying drawing, in which:

FIG. 1 is a partial perspective view of a garment hanger embodying the instant invention;

FIG. 2 is a partial side elevational view of the hanger with indicia in the lateral surface and on the top surface of the neck of the hanger;

FIG. 3 is a partial sectional view taken along line 3—3 of FIG. 2; and

FIG. 4 is a partial sectional view taken along line 4—4 of FIG. 3.

DESCRIPTION OF THE PREFERRED EMBODIMENT

Referring now to FIGS. 1 and 2, there is illustrated therein a portion of a garment hanger, generally indicated at 9, whereon has been attached a raised indicia 11 to a top surface of a neck 12 of the hanger extending above a shoulder 10 of the hanger. Another indicia 14 has been mounted flush at an upper edge of a lateral surface of the neck 12 of the hanger. The laterally mounted indicia 14 herein marked with a garment size is readily visible when a garment is viewed from the side, as when viewing a plurality of garments, each mounted on a hanger embodying the instant invention, arranged on a garment rack. The raised indicia 11, herein marked as a sale tag, is visible above the hanger 9, thereby calling special attention to the instant indicia and can be readily seen from the front and rear of the hanger and at many angles there between. Further, the raised indicia 11 may be mounted in the same mounting 15 with the raised indicia 16 perpendicular to the plane of the hanger as shown in phantom FIG. 2.

Referring now to FIGS. 3 and 4, the raised indicia 11 partially extends downward to form a cross-shaped plug 17 removably received in a cross-shaped socket 18 formed in the neck 12 of the hanger. The lower edge of the raised indicia 11 limits the depth the plug 17 can penetrate into the socket.

The laterally mounted indicia 14 forms a horizontal T-shaped extension 19 extending vertically which is received in a T-shaped slot 20 formed in the neck 12 of the hanger. The depth to which the indicia 14 penetrates into the slot 20 is limited by the sloped face of the indicia 14 which rests in a sloped recess 21 in the lateral face of the neck 12 of the hanger joined to the T-shaped slot.

The front face 22 of indicia 14 is received in a mating recess 23 in the neck of the hanger so as to be flush with the neck of the hanger as best seen in FIG. 4. In this manner, indicia 14 does not project outwardly from the exterior surfaces of the hanger thereby preventing the possibility of damage to the indicia and the possibility that the garment will catch on the indicia means when a garment is removed from and replaced on the hanger.

The hanger of the instant invention is particularly suited to be used as a "ship-on" hanger. Ship-on hangers are purchased by garment manufacturers who place garments on the hangers and ship the garments to the retail stores on the hangers. The garment manufacturer can "size" the garment by utilizing an appropriate indicia 14 with the garment size already imprinted thereon. Alternatively, the garment manufacturer can supply the retailer with the garment on the hanger devoid of indicia 14 and the store personnel can properly size the garment by sliding the correct indicia 14 into slot 20.

If the retail store sells the garment and keeps the hanger, a new garment can be placed thereon and properly sized by removing, if necessary, and indicia 14 carrying the incorrect size and replacing it with one having the correct size.

The hangers are also ideally suited for use by retailers for displaying garments received from manufacturers without hangers. Retailers can then rapidly identify sizes, take inventory, sort and group by size and otherwise effect substantial labor savings by not having to examine individual hang tags.

The indicia 11 can be used for sizing garments or, as shown in the drawings, for providing special information such as the fact that the garment is on "sale" or such other information as the retail store wishes to convey to the prospective purchaser. For example, either of the indicia could carry information relating to color coordination. Indicia 11 could be of any desired shape.

Indicia 11 is removable and readily replaceable as a result of its plug-in connection with the top of the neck of the hanger. Depending on the type of garment rack and orientation of the garments, indicia 11 can be oriented so as to lie in the plane of the hanger as shown in full lines in FIGS. 1 and 2 or it may be oriented to be positioned transversely of the plane of the hanger as shown in phantom lines in FIG. 2.

With the foregoing construction, it can be seen that substantial versatility is provided. If, for example, the garment to be hung on the hanger is one with a large fur collar that might tend to obscure the neck of the hanger, the size information can be provided on indicia 11.

A retail store making use of the hangers would be provided with an inventory of indicias 11 and 14 having different information imprinted thereon so as to maximize its ability to use the hangers for a wide variety of garments.

While the hanger disclosed herein is of the raised neck type, it will be understood that the invention envisions use thereof with any type, style or size of garment hanger with the location of the indicia being determined by the type of information to be conveyed and the use for which the hanger is designed.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. In combination, a garment hanger of the raised neck type and indicia means, said hanger and said indicia means including cooperating means for removably connecting said indicia means to said hanger at said raised neck, said indicia means including a substantially planar surface for receiving information supplied thereto and said cooperating means including a plug-in member of preselected shape formed integrally as part of said indicia means and a slot of a configuration mating with said plug-in member formed integrally with said hanger, said plug-in member being removably mounted in said slot.

2. The combination as claimed in claim 1, wherein both said slot and said plug are cross-shaped in cross-section.

3. The combination as claimed in claim 1 wherein said raised neck has a sloping lateral surface when said hanger is in normal hanging position and said slot is located in said lateral surface.

4. The combination as claimed in claim 3 wherein said slot is T-shaped and said plug-in member mates therewith.

5. The combination as claimed in claim 4 wherein said slot extends through the top surface of said raised neck whereby said plug-in member may be slidably inserted in and removed from said slot.

6. The combination as claimed in claim 3 wherein said planar surface is of pre-determined thickness and said slot includes a recess in said sloping lateral surface, the depth of said recess being at least as great as said pre-determined thickness whereby said planar surface of said indicia means lies substantially flush with said sloping lateral surface when said indicia means is connected to said hanger.

7. In combination, a garment hanger of the raised neck type having a substantially horizontal surface and a sloping lateral surface when said hanger is in normal hanging position, first indicia means including cooperating means for removably connecting said indicia means to said hanger at said substantially horizontal surface and second indicia means including second cooperating means for removably connecting said second indicia means to said hanger along said sloping lateral surface.

* * * * *